US005272409A

United States Patent [19]

Van Dulmen et al.

[11] Patent Number: 5,272,409

[45] Date of Patent: Dec. 21, 1993

[54] CAPPED LAMP/REFLECTOR UNIT

[75] Inventors: Hendrikus A. M. Van Dulmen, Eindhoven, Netherlands; Jaak M. J. Geboers, Aachen; Herbert H. Kreus, Stolberg, both of Fed. Rep. of Germany

[73] Assignee: U.S. Philips Corporation, New York, N.Y.

[21] Appl. No.: 804,251

[22] Filed: Dec. 6, 1991

[30] Foreign Application Priority Data

Jun. 3, 1991 [EP] European Pat. Off. ..... 91201338

[51] Int. Cl.[5] ..... H01J 5/50

[52] U.S. Cl. ..... 313/113; 313/318; 313/332; 439/611; 439/617; 362/310

[58] Field of Search ..... 313/332, 113, 318, 624, 313/625, 580, 634, 333; 439/611, 612, 613, 614, 615, 617; 362/296, 302, 310

[56] References Cited

U.S. PATENT DOCUMENTS

| | | | |
|---|---|---|---|
| 4,287,448 | 9/1981 | Bradley | 313/318 X |
| 4,758,760 | 7/1988 | Cox et al. | 313/318 X |
| 4,985,656 | 1/1991 | Westlund, Jr. et al. | 313/332 X |
| 5,003,217 | 3/1991 | Buschmann | 313/318 |

FOREIGN PATENT DOCUMENTS

| | | |
|---|---|---|
| 0057006 | 1/1982 | European Pat. Off. . |
| 0367323 | 5/1990 | European Pat. Off. . |

*Primary Examiner*—Donald J. Yusko
*Assistant Examiner*—Ashok Patel
*Attorney, Agent, or Firm*—Robert J. Kraus

[57] ABSTRACT

A capped lamp/reflector unit has a reflector body, an electric lamp whose electric element is aligned with respect to the reflector and a cap from which contact pins extend. Within the cap the pins have a widened portion having an end face transverse to the optical axis of the reflector body. The current supply conductors of the electric lamp are cut to length transverse to the axis and butt-welded to the contact pins at the widened portion.

9 Claims, 3 Drawing Sheets

CAPPED LAMP/REFLECTOR UNIT

BACKGROUND OF THE INVENTION

The invention relates to a capped lamp/reflector unit comprising:

a reflector body provided with a concave reflecting surface having an optical axis, and with a neck-shaped portion around said optical axis;

a lamp cap surrounding the neck-shaped portion and having a shell and an end face transverse to the optical axis, from which end face mutually electrically insulated contact pins issue to the exterior;

an electric lamp with an electric element which is positioned on the optical axis and is connected to the contact pins by means of current supply conductors.

Such a unit is known from EP 0 367 323 A.

End portions of the current supply conductors act as the contact pins in this unit. During assembling the electric lamp is to be shifted and possibly tilted in the reflector body in order to be accommodated in such a way that its electric element is aligned with respect to the reflecting surface. A defined position of the electric element is thus accompanied by an undefined position and direction of the contact pins.

Stringent requirements, which render a lamp holder for the unit expensive, are therefore imposed on this lamp holder which must not only hold the lamp cap securely, but also effect electrical connections with the contact pins which have an undetermined position relative to the reflector body and to the lamp cap.

It is nevertheless desirable to provide the unit with pins by way of contact elements, since these pins render it possible to make the lamp suitable for operation at a high or at a low voltage. This is because contact pins are capable of cooperating with contact members of a lampholder which are positioned in recesses, so that the lampholder is safe to touch.

It is not feasible to bend the current supply conductors after alignment of the lamp in such a way that they project from the lamp cap in the correct positions. This is because the current supply conductors are rigid because they must be used as contact pins. Furthermore, bending could undo the positional alignment of the lamp or damage the fastening of the lamp in the reflector body, effected in the known unit by means of cement.

Neither is it attractive to have flexible, for example, comparatively thin current supply conductors cooperate telescopically with contact pins and to fix them therein. This construction would not be possible with widely used diameters of these pins, which are often no thicker than approximately 1 mm. In addition, thin current supply conductors would lead to electrical losses.

SUMMARY OF THE INVENTION

It is an object of the invention to provide a capped lamp/reflector unit of the kind described in the opening paragraph which is of a simple construction that can be easily manufactured, and which nevertheless renders aligned contact pins possible.

According to the invention, this object is achieved in that the contact pins each have within the lamp cap a thickened portion with an end face transverse to the optical axis, against which portion a respective current supply conductor is fastened by means of a butt joint, the contact pins being aligned with respect to the reflector body.

DETAILED DESCRIPTION OF THE INVENTION

Figure 1:
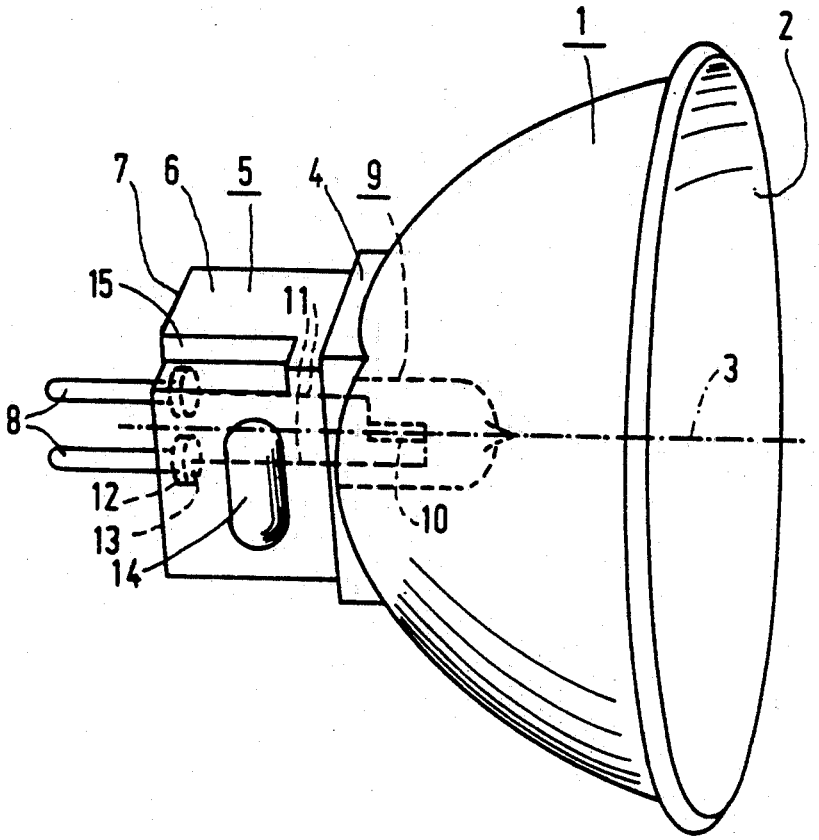
FIG. 1 shows a unit of the invention in perspective view.

During the manufacture of the unit according to the invention, the current supply conductors of a given lamp may be reduced to the correct length after it has been ascertained which position this given lamp is to assume in a reflector body in order to have its electric element in the desired location inside the reflector body. This length reduction may be carried out, for example, by shearing, cutting, sawing, pinching, or grinding, in a plane transverse to the optical axis of the reflector. The position of this plane is defined by the positions of the end faces of the contact pins in a finished unit. Since these end faces are present at respective thickened portions of the contact pins, the current supply conductors may be fastened to these end faces irrespective of their lateral positions relative to the optical axis.

This fastening may be carried out, for example, by means of solder, but preferred are welds, for example, resistance welds or laser welds.

The lamp/reflector unit according to the invention may be realized in various embodiments.

The contact pins may form part of the lamp cap, or alternatively may be separate therefrom.

The electric lamp may be fixed in the reflector body, for example with cement, for example with lamp cement. The contact pins may be connected to the current supply conductor, for example positioned in a jig. The lamp cap may then be provided around the neck-shaped portion of the reflector body and fastened thereto in a previously determined position, for example, by means of cement or a different adhesive, or mechanically, for example, with a snap connection or through the provision of a projection which grips into a recess.

The lamp cap may have, for example, the shape of a sleeve, for example a rectangular sleeve, which does or does not become narrower towards the contact pins. The lamp cap may have a relief transverse to the optical axis, for example a groove or a projection, in order to offer retention members of a lampholder a good grip of the lamp cap. Furthermore, the lamp cap may have a relief in the direction of the optical axis in order to ensure that it fits one particular lampholder, but not another lampholder which provides connection to an incorrect voltage or an incorrect power.

In a simple embodiment, the lamp cap is open at its end face and is filled with cement. Alternatively, the lamp cap may have an opening in its end face for the contact pins, or one opening for each of the contact pins. The lamp cap may be filled with cement, if so desired, through this opening or these openings, or through an additional opening. Cement may be used to increase the rigidity of the unit, if this should be desirable.

The contact pins may be fastened to the lamp cap in embodiments of the unit according to the invention.

The contact pins may be fixed in the end face of the lamp cap, for example through mechanical assembly or in that the end face is formed around said pins, for example from glass, synthetic resin, or ceramic material. In an embodiment, tubular rivets are included in the end face, the contact pins projecting through said rivets. The pins may be soldered or welded so as to be fixed in said rivets.

The lamp cap may be provided as a single unit with the contact pins. The lamp cap then has openings through which the fastenings of the current supply conductors to the respective contact pins are effected.

Alternatively, the end face of the lamp cap with the contact pins may be assembled as a separate part, and subsequently be assembled together with a shell.

The lamp cap may be manufactured wholly or partly from metal, glass, synthetic resin, or ceramic material, depending on the embodiment of the unit.

A favourable embodiment is one in which a metal shell has an inwardly flanged rim near the end face, which rim is enclosed between insulating discs which are interconnected, for example, by means of tubular rivets.

The electric lamp may be, for example, an incandescent lamp with an incandescent body as the electric element, possibly in a gas comprising a halogen, or a discharge lamp with a pair of electrodes in an ionizable gas as the electric element.

The reflector body may be made of, for example, glass, metal or synthetic resin, and may have a fully or a selectively reflecting surface, for example, in that the reflecting surface comprises an interference filter which reflects light and transmits infrared radiation.

Figure 2:
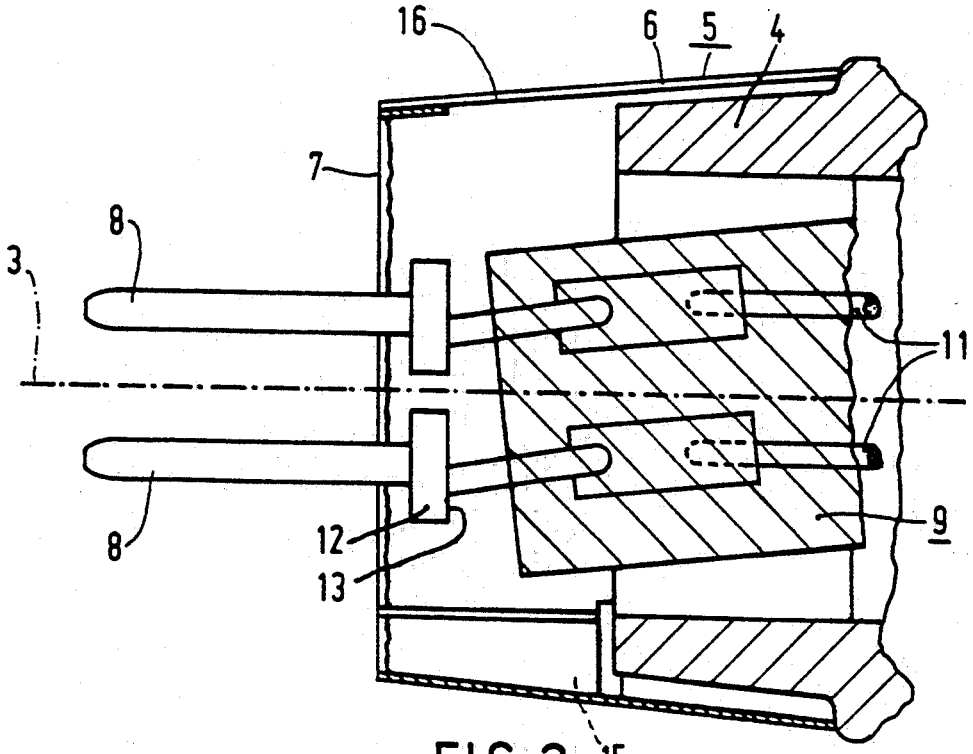
FIG. 2 shows a detail of the unit in FIG. 1 in axial cross-section.
Figure 3A:
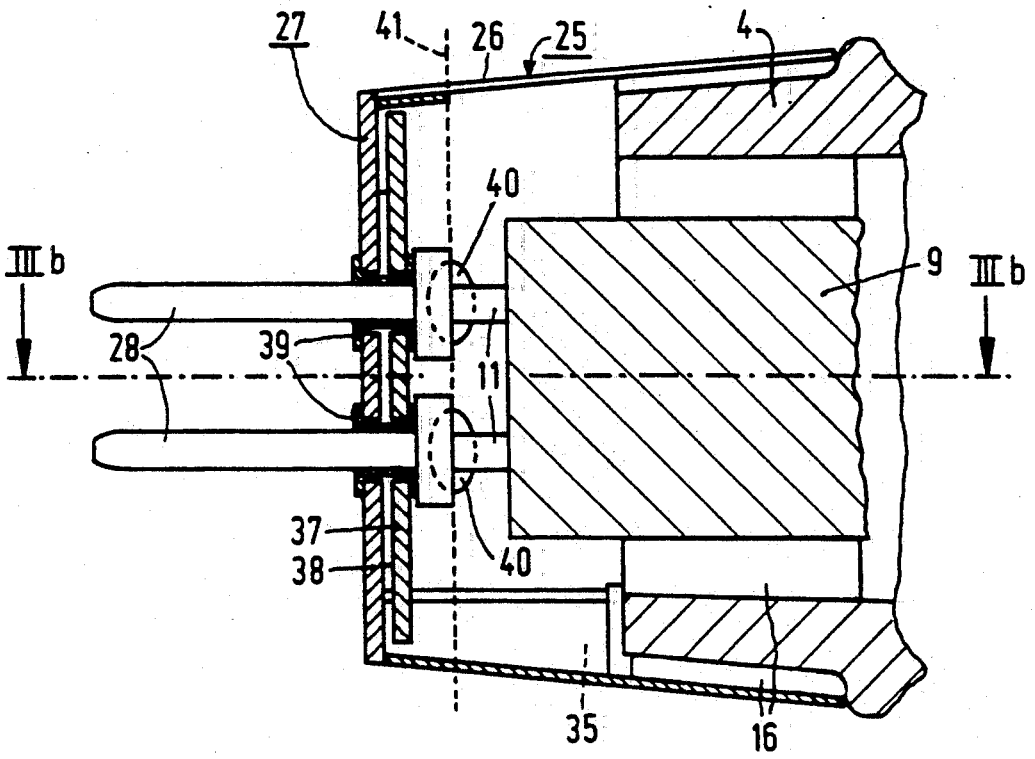
FIGS. 3*a* and 3*b* show a detail of an alternative embodiment of the invention in mutually perpendicular cross-section.
Figure 3B:
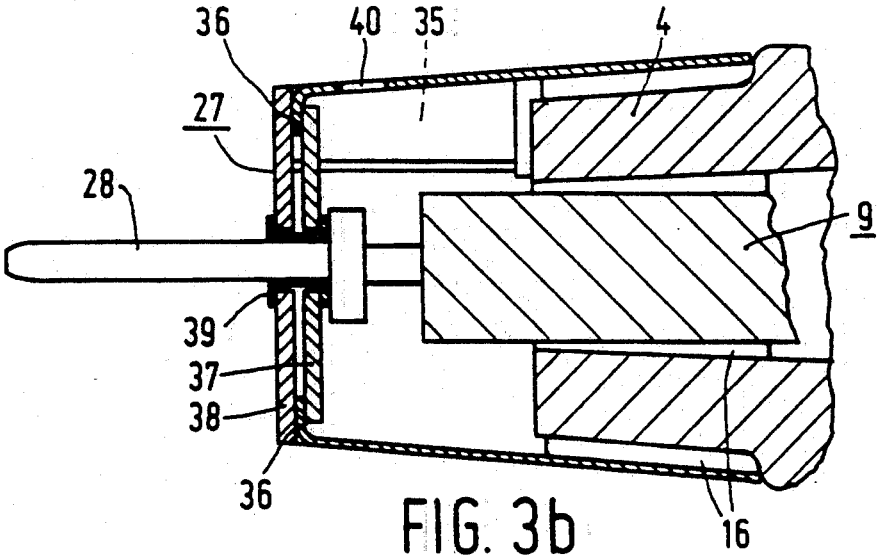
Figure 4:
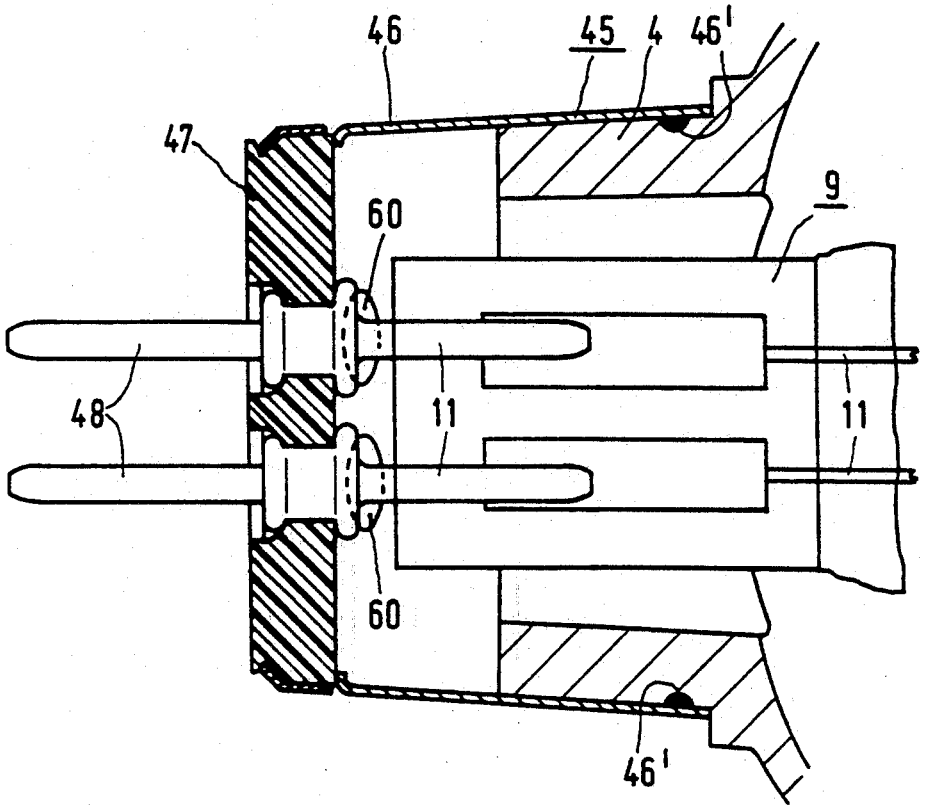
FIG. 4 shows a detail of a further embodiment of the invention in axial cross-section.

Embodiments of the lamp/reflector unit according to the invention are shown in the drawings, in which:

FIG. 1 shows a unit in perspective view;

FIG. 2 shows a detail of the unit of FIG. 1 in axial cross-section;

FIGS. 3*a*, 3*b* shows a detail of an alternative embodiment in mutually perpendicular cross-sections;

FIG. 4 shows a detail of a further embodiment in axial cross-section.

In FIG. 1, the capped lamp/reflector unit has a reflector body 1 which comprises a concave reflecting surface 2 with an optical axis 3. A neck-shaped portion 4 is situated around the optical axis. The reflector body drawn is made of glass and has an infrared-transmitting interference filter (not shown) at the reflecting surface. The unit has a lamp cap 5 around the neck-shaped portion 4 (see also FIG. 2), which portion comprises a shell 6 and an end face 7 transverse to the optical axis 3, from which end face mutually electrically insulated contact pins 8 project to the exterior. An electric lamp 9 has an electric element 10, an incandescent body FIG. 1, which electric lamp 9 is positioned on the optical axis 3 and which is connected to the contact pins 8 by means of current supply conductors 11.

The contact pins 8, which are aligned with respect to the optical axis 3 of the reflector body 1, each have a thickened portion 12 with an end face 13 transverse to the optical axis 3 inside the lamp cap 5. Against these end faces 13, respective current supply conductors 11 are fastened by means of butt joints, for example welds, such as laser welds.

In the unit shown in FIGS. 1 and 2, the electric lamp 9 is fixed in the reflector body 1 with lamp cement 16, more particularly in the neck-shaped portion 4 of this body, with the incandescent body 10 positioned concentrically with respect to the optical axis 3. If the incandescent body 10 has a skew position in the lamp, the lamp will have a skew position relative to the reflector body as a result of this concentric position of the incandescent body. The current supply conductors 11, for example made of molybdenum, are then reduced in length along a plane transverse to the optical axis 3. The contact pins 8, for example made of nickel, possibly with a silver coating at the end faces 13 of the thickened portions 12, are then positioned with the end faces 13 against the current supply conductors positions relative to the reflector body, for example relative to the optical axis, which has been previously determined. Butt joints are then made, e.g. butt welds, with a laser, between the end faces 13 and the current supply conductors 11. The lamp cap 5 is subsequently provided and fixed with lamp cement 16, which is supplied through the open end face 7, after which the lamp cap is aligned relative to the reflector body 1, for example relative to the optical axis 3.

Irrespective of the position of the incandescent body in the electric lamp, the contact pins and the lamp cap have a previously determined position relative to the reflector body and relative to one another. As a result, the unit renders it possible for the contact pins to be aligned in spite of its simple and easily realizable construction. A lampholder for the unit can thus be of a simple construction and nevertheless make electrical contact with the contact pins, while at the same time holding the lamp cap mechanically fixed. Mechanical fixation may be achieved, for example, through cooperation with a relief 14 transverse to the optical axis 3, a projection in FIG. 1, but in an alternative unit, may be for example, a groove, by which a positive retention is obtained. The lamp holder may also have a projection which cooperates with a relief 15 in the direction of the optical axis 3 in order to prevent the insertion of a unit not designed for the relevant lamp holder, or to prevent incorrect insertion.

In FIGS. 3*a*, 3*b* and 4, corresponding parts of the lamp cap and the contact pins are given reference numerals which are 20 higher each time than those in the preceding Figure.

In FIGS. 3*a* and 3*b*, the shell 26 of the lamp cap 25 has a flanged rim 36 (FIG. 3*b*) near the end face 27, which rim is enclosed between insulating discs 37, 38 made of, for example, synthetic resin or ceramic material. These parts are held together by means of tubular rivets 39. After alignment, the lamp 9 is fixed in the neck-shaped portion 4 with cement 16. The current supply conductors are reduced along length in a plane 41 transverse to the optical axis 3. Two alternative methods may be followed after this. The contact pins 28 may be fastened and the lamp cap 25 may be provided and fixed with cement 16. The contact pins 28 may then be fastened to the tubular rivets 39. Alternatively, the lamp cap 25 may be provided with the contact pins 28 already fixed in the tubular rivets 39, after which the butt welds between the contact pins 28 and the current supply conductors 11 are made through openings 40 in the shell 26 of the lamp cap 25. These openings may also be used for filling the lamp cap with cement, if so desired.

In FIG. 4 the end face 47 may be formed around the contact pins 48. In the embodiment shown, however, the contact pins are fixed in a pre-formed end face.

The lamp 9 may be fixed in the neck-shaped portion 4, after which the lamp cap 45 is provided and fixed by means of the projections 46'. The connections between the contact pins 48 and the current supply conductors 11 may then be made through the openings 60. An alternative, however, is for the end face 47 to be fixed to the shell 46 through local deformation of the shell as a final step.

An alternative realization, however, is that the lamp 9 is aligned in a separate appliance, its current supply conductors are reduced to the correct length, and that the contact pins are then welded thereto in correct alignment. Subsequently, a subassembly of lamp, lamp cap and contact pins may be provided in, around and against the reflector body and be connected thereto. The cavity in the lamp cap 45 may then be filled with cement, if applicable.

We claim:

1. A capped lamp/reflector unit comprising:

a reflector body (1) provided with a concave reflecting surface (2) having an optical axis (3), and with a neck-shaped portion (4) around said optical axis;

a lamp cap (5) surrounding the neck-shaped portion (4) and having a shell (6) and an end face (7) transverse to the optical axis (3), from which end face (7) mutually electrically insulated contact pins (8) issue to the exterior;

an electric lamp (9) with an electric element (10) which is positioned on the optical axis (3) and is connected to the contact pins (8) by means of current supply conductors (11);

characterized in that the contact pins (8) each have within the lamp cap (5) a thickened portion (12) with an end face (13) transverse to the optical axis (3), against which thickened end portion a respective current supply conductor (11) is fastened by means of a butt joint, the contact pins (8) being aligned with respect to the reflector body (1).

2. A capped lamp/reflector unit as claimed in claim 1, characterized in that the end face (7) of the lamp cap (5) has an opening from which two contact pins (8) project to the exterior.

3. A capped lamp/reflector unit as claimed in claim 1, characterized in that the shell (6) of the lamp cap (5) has a first relief (14) transverse to the optical axis (3).

4. A capped lamp/reflector unit as claimed in claim 3, characterized in that the shell (6) has a second relief (15) in the direction of the optical axis (3).

5. A capped lamp/reflector unit comprising:

a reflector body (1) provided with a concave reflecting surface (2) having an optical axis (IIIb) and with a neck-shaped portion (4) around said optical axis;

a lamp cap (25) surrounding the neck-shaped portion (4) and having a shell (26) and an end face (27) transverse to the optical axis (IIIb) from which end face (27) mutually exclusive insulated contact pins (28) project to the exterior;

an electric lamp (9) provided with an electric element (10) which element (10) is positioned on the optical axis (IIIb) and is connected to the contact pins (28) by means of current supply conductors (11);

characterized in that the contact pins (28) are fastened to the end-face (27), each contact pin (28) has within the lamp cap (25) a thickened end portion (12) with an end-face (13) transverse to the optical axis (IIIb) against which thickened end portion (12) a current supply conductor (11) is fastened by means of a butt joint, the contact pins (28) being aligned with respect to the reflector body (1).

6. A capped lamp/reflector unit as claimed in claim 5, characterized in that the end face (27) is provided with tubular rivets (39) through which the contact pins (28) project to the exterior and to which tubular rivets (39) said contact pins are fastened.

7. A capped lens/reflector unit as claimed in claim 6, characterized in that the shell (29) of the lamp cap (25) has a flagged rim (36), traverse to the optical axis (iiib) which is enclosed between insulating discs (37, 38) present in the end face (27) and transverse to the optical axis (iiib).

8. A capped lamp/reflector unit as claimed in claim 5, characterized in that the end face (27) is mechanically fastened to the shell (26) of the lamp cap (25).

9. A capped lamp/reflector unit as claimed in claim 5, characterized in that the shell (26) has at least one opening (46) through which is suitable to mold a butt joint between a contact pin (28) and a corresponding current supply conductor (11).

* * * * *